US008330394B2

(12) United States Patent
Custodis

(10) Patent No.: US 8,330,394 B2
(45) Date of Patent: Dec. 11, 2012

(54) LIGHT SOURCE OF LED AND METHOD FOR PRODUCING LIGHT SOURCE WITH VARYING COLOR WHILE DIMMING

(75) Inventor: Udo Custodis, Hsin-Chu (TW)

(73) Assignee: Young Lighting Technology Inc., Hsin-Chu (TW)

( * ) Notice: Subject to any disclaimer, the term of this patent is extended or adjusted under 35 U.S.C. 154(b) by 316 days.

(21) Appl. No.: 12/757,045

(22) Filed: Apr. 9, 2010

(65) Prior Publication Data

US 2011/0248645 A1 Oct. 13, 2011

(51) Int. Cl.
*H05B 37/00* (2006.01)
*H05B 39/04* (2006.01)

(52) U.S. Cl. ..... 315/312; 315/307

(58) Field of Classification Search ..... 315/307, 315/291, 312, 246, 224; 307/10.8, 77
See application file for complete search history.

(56) References Cited

U.S. PATENT DOCUMENTS

| | | | | |
|---|---|---|---|---|
| 7,105,945 | B2 * | 9/2006 | Shiotsu et al. | 307/10.8 |
| 7,173,383 | B2 * | 2/2007 | Vornsand et al. | 315/291 |
| 7,547,113 | B2 * | 6/2009 | Lee | 362/231 |
| 7,625,098 | B2 * | 12/2009 | Rains et al. | 362/231 |
| 7,723,926 | B2 * | 5/2010 | Mednik et al. | 315/291 |
| 2009/0273331 | A1 * | 11/2009 | Inoue | 323/312 |

FOREIGN PATENT DOCUMENTS

| | | |
|---|---|---|
| TW | 532699 | 5/2003 |
| TW | I226791 | 1/2005 |
| TW | M332777 | 5/2008 |

* cited by examiner

*Primary Examiner* — Minh D A
(74) *Attorney, Agent, or Firm* — Jianq Chyun IP Office

(57) ABSTRACT

A light source of LED includes at least one first LED and at least one second LED. The first LED has a first optical illuminant characteristic varying with a variable operation voltage from a first level to a second level, wherein the first level is larger than the second level. The second LED has a second optical illuminant characteristic varying with the variable operation voltage from a third level to a fourth level, wherein the third level is smaller than the fourth level. The first LED and the second LED are simultaneously controlled by the same variable operation voltage to produce a light.

16 Claims, 8 Drawing Sheets

LIGHT SOURCE OF LED AND METHOD FOR PRODUCING LIGHT SOURCE WITH VARYING COLOR WHILE DIMMING

BACKGROUND OF THE INVENTION

1. Field of Invention

The present invention relates to a light source using light-emitting diode (LED). More particularly, the present invention relates to a light source, which could have a color change approach to warm color when dimming the light.

2. Description of Related Art

LED is one of the light sources in various applications. Based on the properties of the LED, different LEDs could emit different colors, such as red, green, blue, or amber. For a light source as a lamp, it may need several LEDs to form a lamp. The popular lamp of LED is producing white light to replace the rather conventional filament incandescent lamp. Generally, the light emitted by the LED is relating to the color temperature, which is further relating to the operation voltage being applied. In order to have adjustable color temperature for the lamp, several conventional lamps including multiple LEDs under control have been proposed.

The disclosure of a patent of I226791 in Taiwan has disclosed a lamp, which uses three LEDs of red, green, and blue. Three LEDs are separately controlled with the operation voltage. The RGB lights produced by the RGB LEDs are mixed into a desired color.

Further in the disclosure of a patent of 532699 in Taiwan, a lamp is also designed with three LEDs. The three LEDs form as a unit and are covered by an envelope as a light bulb. Each LED is separately controlled by a different voltage to change the light brightness and color.

Further in the disclosure of a patent of M332777 in Taiwan, a lamp is designed with two types of LEDs, which are arranged in a 2D array at a plane. The first light emitting diode emits a light beam with a first color temperature and the second light emitting diode emits a light beam with a second color temperature. A control unit controls a variable resistance to modulate the current passing through the second light emitting diode. Thus, the color temperature of the lamp could be changed.

In the conventional design for the lamp, each different type of LED is separately controlled, so as to produce the mixed light in adjustable color. However, the dimming effect of the LED lamp is not taken into consideration.

SUMMARY OF THE INVENTION

The invention provides a light source using LED, which can be adjusted in brightness and the color temperature by the same operation voltage. When the light is dimmed, the color could accordingly change from white approaching to red. The method for producing the light source is provided, as well.

An embodiment of the invention provides a light source of LED, including at least one first LED and at least one second LED. The first LED has a first optical illuminant characteristic varying with a variable operation voltage from a first level to a second level, wherein the first level is larger than the second level. The second LED has a second optical illuminant characteristic varying with the variable operation voltage from a third level to a fourth level, wherein the third level is smaller than the fourth level. The first LED and the second LED are simultaneously controlled by the same variable operation voltage to produce a light.

In an embodiment, both the first LED and the second LED are white color, and the first LED starts from a warm state in color temperature and the second LED starts from a cool state in color temperature when the variable operation voltage is at full percentage of a reference voltage.

In an embodiment, the first LED is a white LED and the second LED is a color LED warmer than the white LED when the variable operation voltage is at full percentage of a reference voltage.

Another embodiment of the invention also provides a method for producing a light using light-emitting diode (LED.) The method includes providing at least one first LED, the first LED having a first optical illuminant characteristic varying with a variable operation voltage from a first level to a second level, wherein the first level is larger than the second level. The method also includes providing at least one second LED, the second LED having a second optical illuminant characteristic varying with the variable operation voltage from a third level to a fourth level, wherein the third level is smaller than the fourth level. Then, the variable operation voltage is simultaneously applied to the first LED and the second LED to produce a light.

In an embodiment, the first LED and the second LED could be both white, and the first LED is cooler than the second LED in varying with the operation voltage from full percentage to lower percentage.

Other objectives, features and advantages of the present invention will be further understood from the further technological features disclosed by the embodiments of the present invention wherein there are shown and described preferred embodiments of this invention, simply by way of illustration of modes best suited to carry out the invention.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE PREFERRED EMBODIMENTS

It is to be understood that other embodiment may be utilized and structural changes may be made without departing from the scope of the present invention. Also, it is to be understood that the phraseology and terminology used herein are for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings.

In an embodiment of the invention, the lamp could be composed from a white LED with color LEDs, for example, a red LED and/or an amber LED in combination or composed from two white LEDs with the lower color temperature and higher color temperature in combination, to create a "dimming curve". Both controls of the LEDs able to be done by a single variable operation voltage and the color temperature and the Lumen output are changed, accordingly.

When considering the phenomenon of the dimming characteristic of LED in comparison to tungsten filament incandescent lamps, there is a different visual effect to eyes. For tungsten filament incandescent lamps, when the light is dimmed, the color usually changes from white approaching to red. This causes a more comfortable feeling to the eye. However, if an LED lamp is dimmed, the color temperature does not change with the decreasing of lumen output. User of incandescent lamps standard or Halogen are usually used to the effect that the color temperature is decreasing with the lumen output in a very special characteristic.

Figure 1:
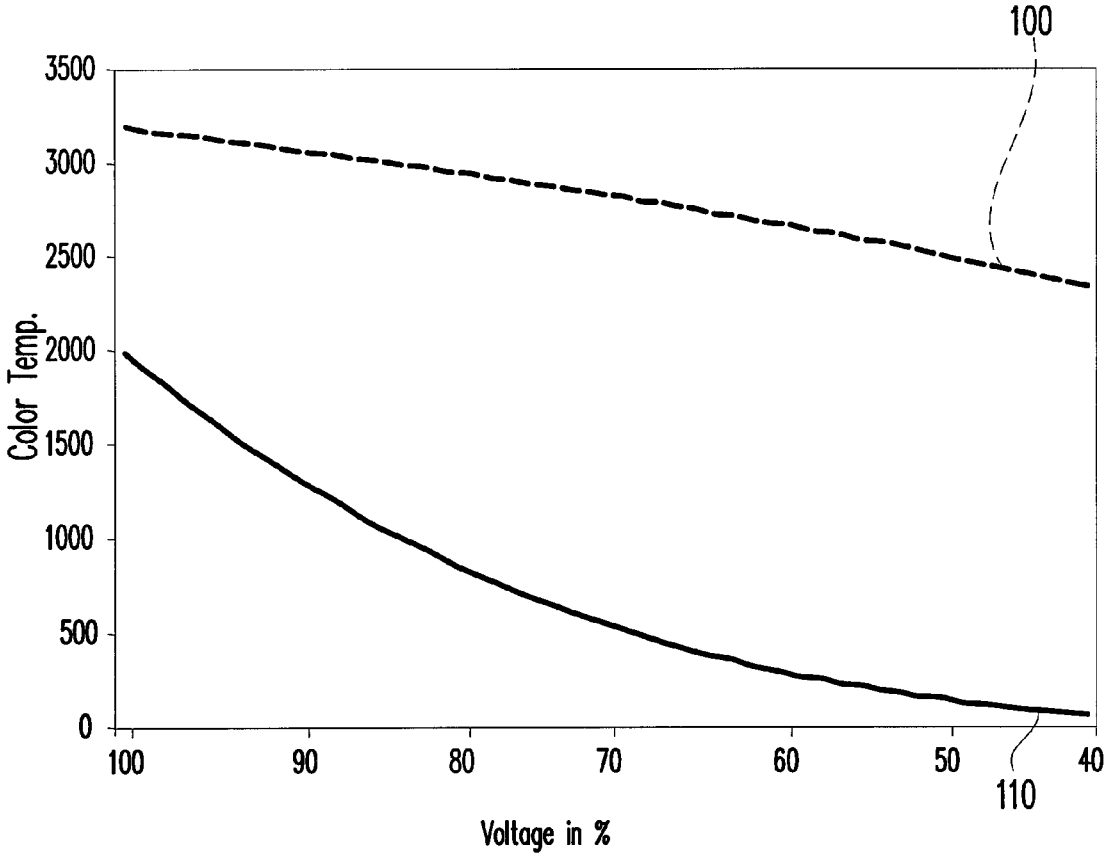
FIG. 1 is a drawing, schematically illustrating the curves for the variations of the color temperature in Kelvin and the brightness in Lumen corresponding to the color temperature as the change of operation voltage in percentage.

FIG. 1 is a drawing, schematically illustrating the curves for the variations of the color temperature in Kelvin and the brightness in Lumen corresponding to the color temperature as the change of operation voltage in percentage. In FIG. 1, the color temperature in dashed curve 100 is decreasing when the operation voltage is decreasing, indicated by percentage from a normal voltage, that is also a reference voltage. At the same time, variation of the brightness in lumen unit is shown in solid line 110. When the light output decreases, the color temperature decreases as well. This is the characteristic being used to most of users and known as the warn feeling when dimming the lamp.

However, the warm feeling is at least an issue under consideration for the LED lamp. The embodiment provides a solution in an easy manner that the user could behave like the way for the tungsten filament lamps. The embodiment uses a standard dimmer and the color temperature is able to be changed according to the lumen output in the same manner as an incandescent lamp does. The user feels the same light characteristic as before with the conventional light source. The embodiment has various applications.

Several embodiments are provided for describing the invention. However, the invention is not just limited to the provided embodiments. In addition, the embodiments are properly combined to each other, as well.

Figure 2:
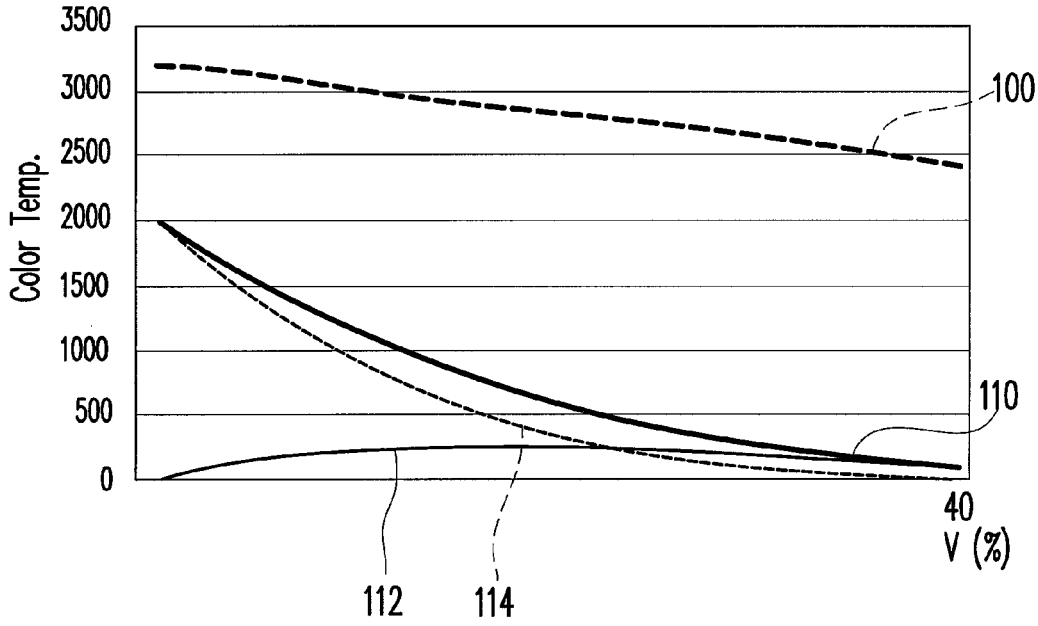
FIG. 2 is a drawing, schematically illustrating the curves for the variations of the color temperature in Kelvin and the brightness in Lumen, according to an embodiment of the invention.

In an embodiment, the light source takes two LED units as an example. FIG. 2 is a drawing, schematically illustrating the curves for the variations of the color temperature in Kelvin and the brightness in Lumen, according to an embodiment of the invention. In FIG. 2 as the example, both the first LED and the second LED are a white LED, and operated in different color temperatures. The first LED is, for example, at a high color temperature, such as 3200K at cool state. The second LED is, for example, at low color temperature, such as 2400K at warm state.

The first LED has a first optical illuminant characteristic 114 varying with a variable operation voltage from a first level, such as 2000K to a second level corresponding to the operation voltage at 40%. The second LED has a second optical illuminant characteristic 112 varying with the variable operation voltage from a third level corresponding to a full percentage of operation voltage to a fourth level corresponding to a 40% of operation voltage. The first LED and the second LED are simultaneously controlled by the same variable operation voltage to produce a light, which has the lumen curve 110 of the total optical illuminant characteristic, summing from the first and the second optical illuminant characteristics 112 and 114.

It should be noted that the color temperature as shown in dashed curve 110 is descending to produce warm feeling.

The relation between the color temperature and the lumen output could be described by the correlation equations. The lumen curve (Lmx) 110 and the color temperature curve 100 (Kx) could be changed by controlling the lumen of the two LEDs separately, wherein x represents the percentage of the operation voltage in percentage. The correlation equations, in accordance with Table 1, are follows:

$$Bx=(Kx-Ac)*Lmx/(Bc-Ac); \text{ and} \quad (1)$$

$$Ax=Lmx-Bx. \quad (2)$$

In addition, the $Kx=U^{3.4\ to\ 4.0}$, $Lmx=U^{3.6\ to\ 3.0}$, U represents the actual value of the voltage. Therein, for Kx, a fixed index value from the index range of 3.4 to 4.0 is selected and for Lmx, a fixed index value from the index range of 3.6 to 3.0 is selected by request. The characteristic of Ax and Bx are known, depending on the behaviors of LEDs, so that the Lumen curve 110 and the color temperature curve 100 could be obtained. In other way, when the Lumen curve 110 and the temperature curve 100 are expected, then the choices of the LEDs are able to be determined.

TABLE 1

| Voltage % | Lumen (Lmx) | Kelvin (Kx) | LED (cool) 3200K (Ac) lm(Ax) | LED (Warm) 2400K (Bc) lm(Bx) |
|---|---|---|---|---|
| 100 | 2000 | 3200 | 2000 | 0 |
| 99 | 1929 | 3189 | 1903 | 26 |
| 98 | 1860 | 3178 | 1809 | 51 |
| 97 | 1792 | 3167 | 1718 | 74 |
| 96 | 1727 | 3156 | 1631 | 95 |
| 95 | 1663 | 3145 | 1548 | 115 |
| 94 | 1601 | 3133 | 1467 | 133 |
| 93 | 1540 | 3122 | 1390 | 150 |
| 92 | 1481 | 3111 | 1316 | 166 |
| 91 | 1424 | 3099 | 1244 | 180 |
| 90 | 1369 | 3087 | 1176 | 193 |
| 89 | 1315 | 3076 | 1110 | 204 |
| 88 | 1262 | 3064 | 1048 | 215 |
| 87 | 1211 | 3052 | 987 | 224 |
| 86 | 1162 | 3040 | 930 | 232 |

TABLE 1-continued

| Voltage % | Lumen (Lmx) | Kelvin (Kx) | LED (cool) 3200K (Ac) lm(Ax) | LED (Warm) 2400K (Bc) lm(Bx) |
|---|---|---|---|---|
| 85 | 1114 | 3028 | 875 | 240 |
| 84 | 1068 | 3016 | 822 | 246 |
| 83 | 1023 | 3004 | 772 | 251 |
| 82 | 979 | 2991 | 723 | 255 |
| 81 | 937 | 2979 | 678 | 259 |
| 80 | 896 | 2966 | 634 | 262 |
| 79 | 856 | 2954 | 592 | 264 |
| 78 | 818 | 2941 | 553 | 265 |
| 77 | 781 | 2928 | 515 | 265 |
| 76 | 745 | 2915 | 479 | 265 |
| 75 | 710 | 2902 | 445 | 265 |
| 74 | 676 | 2889 | 413 | 263 |
| 73 | 644 | 2875 | 383 | 261 |
| 72 | 613 | 2862 | 354 | 259 |
| 71 | 583 | 2848 | 327 | 256 |
| 70 | 554 | 2835 | 301 | 253 |
| 69 | 526 | 2821 | 277 | 249 |
| 68 | 499 | 2807 | 254 | 245 |
| 67 | 473 | 2793 | 232 | 241 |
| 66 | 448 | 2778 | 212 | 236 |
| 65 | 424 | 2764 | 193 | 231 |
| 64 | 401 | 2749 | 175 | 226 |
| 63 | 379 | 2735 | 159 | 220 |
| 62 | 358 | 2720 | 143 | 215 |
| 61 | 337 | 2705 | 129 | 209 |
| 60 | 318 | 2690 | 115 | 203 |
| 59 | 299 | 2674 | 103 | 197 |
| 58 | 281 | 2659 | 91 | 190 |
| 57 | 264 | 2643 | 80 | 184 |
| 56 | 248 | 2627 | 71 | 178 |
| 55 | 232 | 2611 | 61 | 171 |
| 54 | 218 | 2595 | 53 | 165 |
| 53 | 203 | 2579 | 45 | 158 |
| 52 | 190 | 2562 | 38 | 151 |
| 51 | 177 | 2545 | 32 | 145 |
| 50 | 165 | 2528 | 26 | 139 |
| 49 | 153 | 2511 | 21 | 132 |
| 48 | 142 | 2493 | 17 | 126 |
| 47 | 132 | 2476 | 12 | 120 |
| 46 | 122 | 2457 | 9 | 113 |
| 45 | 113 | 2439 | 6 | 107 |
| 44 | 104 | 2421 | 3 | 101 |
| 43 | 96 | 2402 | 0 | 96 |
| 42 | 88 | 2383 | −2 | 90 |
| 41 | 81 | 2363 | −4 | 84 |
| 40 | 74 | 2343 | −5 | 79 |

Remarkably, the above example is taking two while LED as the example. The voltage percentage is calculated from the 100% down to 40% of a standard voltage. However in actual design, the voltage may just be operated a certain range of percentage. In addition, the number of LED is not just two in general.

Figure 3:
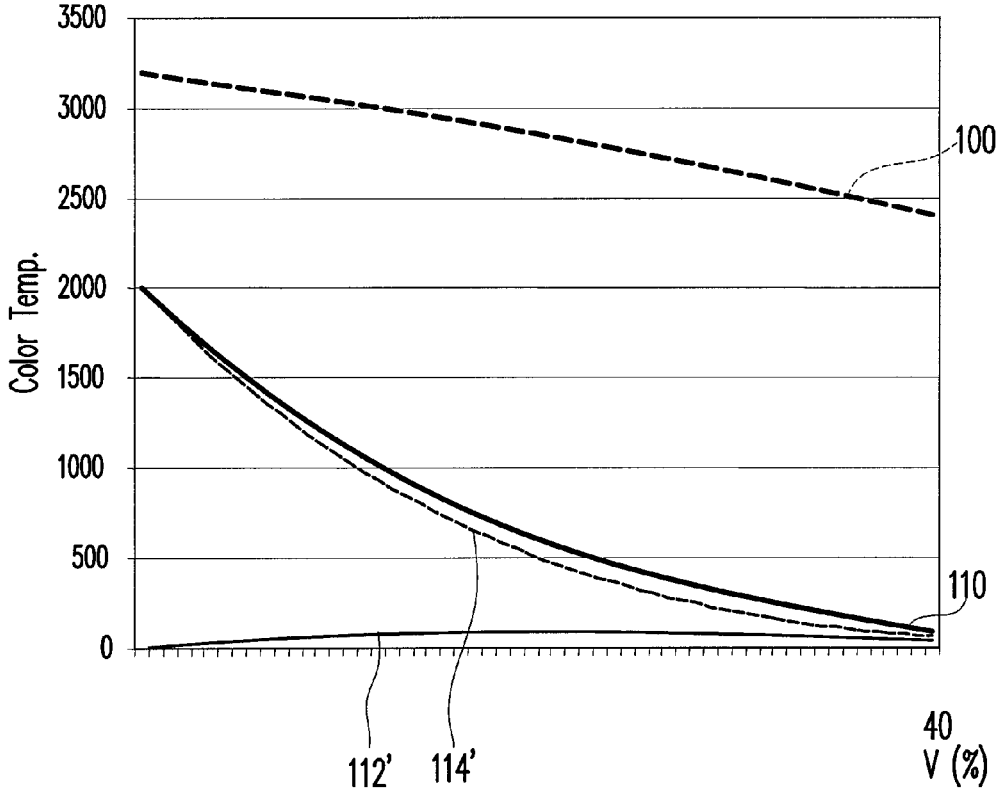
FIG. 3 is a drawing, schematically illustrating the curves for the variations of the color temperature in Kelvin and the brightness in Lumen, further according to an embodiment of the invention.

In another embodiment, the choice of the LEDs may be one white LED with one amber LED such as red LED, corresponding to the color temperature of 1000 k. FIG. 3 is a drawing, schematically illustrating the curves for the variations of the color temperature in Kelvin and the brightness in Lumen, further according to an embodiment of the invention.

In FIG. 3, one of the LED is red at the initial condition before dimming. Under the proper choice the characteristic of the red LED, the behavior is like the behavior in FIG. 2 but in different quantities. Table 2 shows the calculated results in one example, corresponding to the curves in FIG. 3.

TABLE 2

| Voltage % | Lumen | Kelvin | LED 3200 lm | LED 1000 lm |
|---|---|---|---|---|
| 100 | 2000 | 3200 | 2000 | 0 |
| 99 | 1929 | 3189 | 1919 | 10 |
| 98 | 1860 | 3178 | 1841 | 19 |
| 97 | 1792 | 3167 | 1765 | 27 |
| 96 | 1727 | 3156 | 1692 | 35 |
| 95 | 1663 | 3145 | 1621 | 42 |
| 94 | 1601 | 3133 | 1552 | 48 |
| 93 | 1540 | 3122 | 1486 | 55 |
| 92 | 1481 | 3111 | 1421 | 60 |
| 91 | 1424 | 3099 | 1359 | 65 |
| 90 | 1369 | 3087 | 1299 | 70 |
| 89 | 1315 | 3076 | 1240 | 74 |
| 88 | 1262 | 3064 | 1184 | 78 |
| 87 | 1211 | 3052 | 1130 | 81 |
| 86 | 1162 | 3040 | 1078 | 84 |
| 85 | 1114 | 3028 | 1027 | 87 |
| 84 | 1068 | 3016 | 978 | 89 |
| 83 | 1023 | 3004 | 931 | 91 |
| 82 | 979 | 2991 | 886 | 93 |
| 81 | 937 | 2979 | 842 | 94 |
| 80 | 896 | 2966 | 800 | 95 |
| 79 | 856 | 2954 | 760 | 96 |
| 78 | 818 | 2941 | 721 | 96 |
| 77 | 781 | 2928 | 684 | 97 |
| 76 | 745 | 2915 | 648 | 96 |
| 75 | 710 | 2902 | 614 | 96 |
| 74 | 676 | 2889 | 581 | 96 |
| 73 | 644 | 2875 | 549 | 95 |
| 72 | 613 | 2862 | 519 | 94 |
| 71 | 583 | 2848 | 490 | 93 |
| 70 | 554 | 2835 | 462 | 92 |
| 69 | 526 | 2821 | 435 | 91 |
| 68 | 499 | 2807 | 410 | 89 |
| 67 | 473 | 2793 | 385 | 88 |
| 66 | 448 | 2778 | 362 | 86 |
| 65 | 424 | 2764 | 340 | 84 |
| 64 | 401 | 2749 | 319 | 82 |
| 63 | 379 | 2735 | 299 | 80 |
| 62 | 358 | 2720 | 280 | 78 |
| 61 | 337 | 2705 | 262 | 76 |
| 60 | 318 | 2690 | 244 | 74 |
| 59 | 299 | 2674 | 228 | 71 |
| 58 | 281 | 2659 | 212 | 69 |
| 57 | 264 | 2643 | 197 | 67 |
| 56 | 248 | 2627 | 183 | 65 |
| 55 | 232 | 2611 | 170 | 62 |
| 54 | 218 | 2595 | 158 | 60 |
| 53 | 203 | 2579 | 146 | 57 |
| 52 | 190 | 2562 | 135 | 55 |
| 51 | 177 | 2545 | 124 | 53 |
| 50 | 165 | 2528 | 115 | 50 |
| 49 | 153 | 2511 | 105 | 48 |
| 48 | 142 | 2493 | 97 | 46 |
| 47 | 132 | 2476 | 89 | 43 |
| 46 | 122 | 2457 | 81 | 41 |
| 45 | 113 | 2439 | 74 | 39 |
| 44 | 104 | 2421 | 67 | 37 |
| 43 | 96 | 2402 | 61 | 35 |
| 42 | 88 | 2383 | 55 | 33 |
| 41 | 81 | 2363 | 50 | 31 |
| 40 | 74 | 2343 | 45 | 29 |

As can be seen, the combination of the two LEDs could be tuned by the same single operation voltage. The brightness could be dimmed while the color temperature is descending as well. The embodiments could indeed produce the warm feeling to the eye. Based on the proposed principle, the LEDs could be used to actually form a lamp in various designs.

Figure 4:
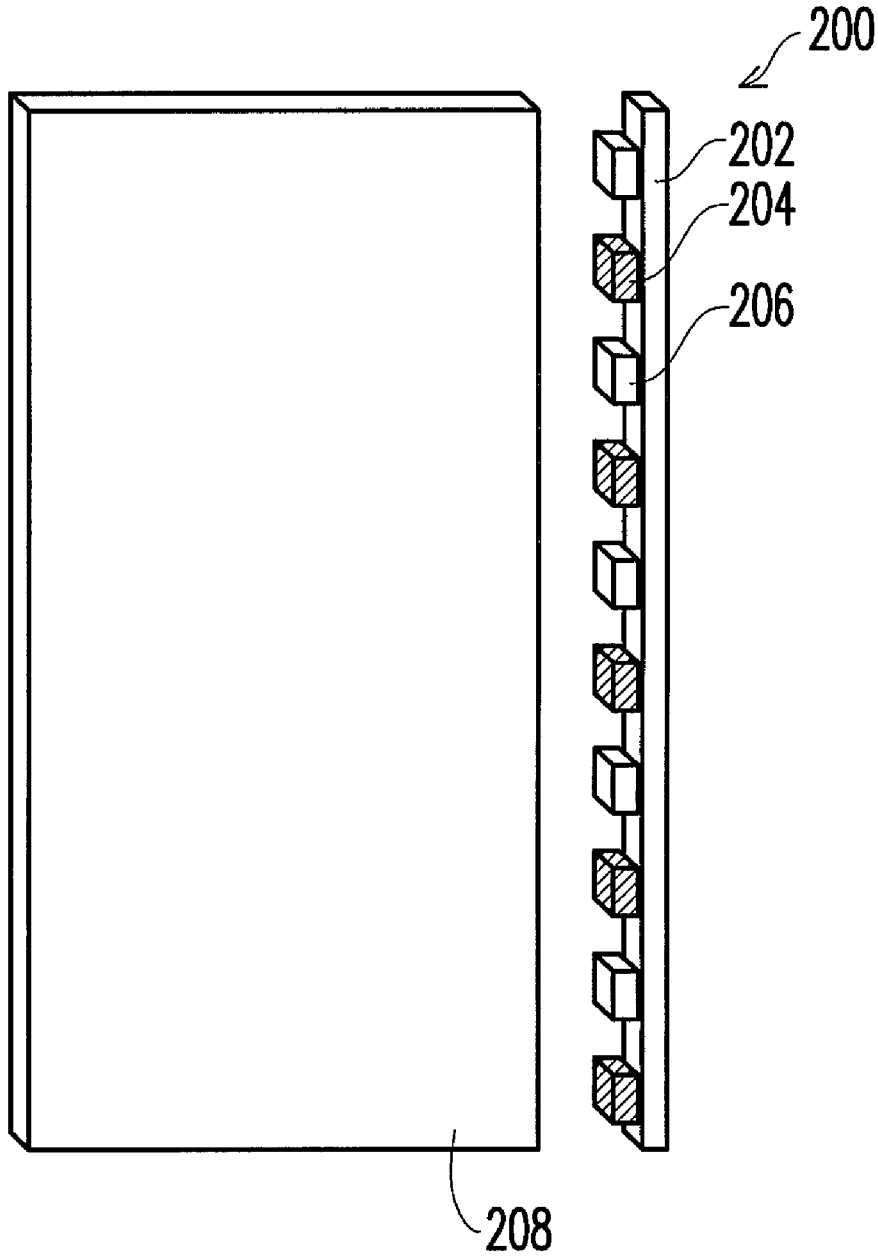
FIG. 4 is a drawing, schematically illustrating a structure of a flat lamp in perspective view, according to an embodiment of the present invention.

FIG. 4 is a drawing, schematically illustrating a structure of a flat lamp in perspective view, according to an embodiment of the present invention. In FIG. 4, a flat LED lamp is able to be fabricated by using the light source of the invention. In this example, the LED units 204 and 206 are implemented on a base 202 to form a light source 200. In one example, the two LED units 204 and 206 could be alternatively disposed on the base 202. A light integrating plate 208 is, for example, used to collect the individual lights from the LED units 204 and 206 in different types with the characteristic shown in FIG. 2 or FIG. 3. The light integrating plate 208 integrates the individual lights from the side at the incident surface and mixes the lights into a more uniform flat light. For the application of flat lamp, the light integrating plate 208 could be known by the one with ordinary skill in the art.

Figure 5:
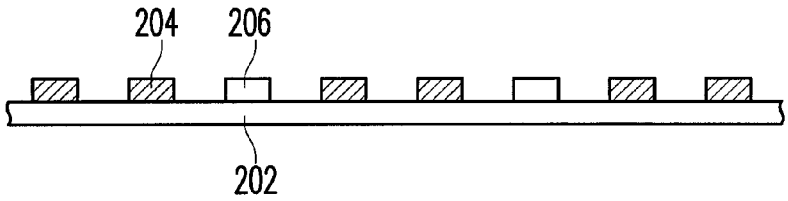
FIG. 5 is a drawing, schematically illustrating a structure of a light source in side view, according to an embodiment of the present invention.

FIG. 5 is a drawing, schematically illustrating a structure of a light source in side view, according to an embodiment of the present invention. In FIG. 5, the number of the two types of LED units 204 and 206 could be equal or different. The LED pattern is also be set in actual design. In this example, the LED units 204 and the LED units 206 could be two to one. In other words, the LED units 206 are disposed in every other two LED units 204. There is no specific LED pattern is required, generally.

Figure 6:
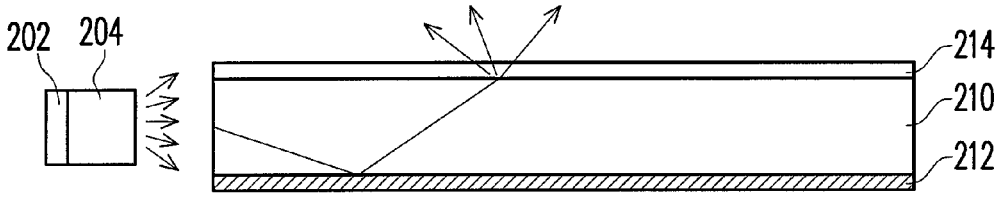
FIG. 6 is a drawing, schematically illustrating a structure of a flat light source in side view, according to an embodiment of the present invention.

FIG. 6 is a drawing, schematically illustrating a structure of a flat light source in side view, according to an embodiment of the present invention. In FIG. 6, the LED units emit lights to the light integrating plate. The light integrating plate includes a light guide plate 210 with the reflection layer 212 at one side. The reflection layer 212 may also have a surface with micro-structures to be better reflection effect. In addition, in order to get the output light to be more uniform, an optical diffuser 214 may be formed on the other side of the light guide plate 210. The invention is not limited to the specific structure of the flat lamp. However, the optical characteristic with the examples in FIG. 2 and FIG. 3 are involved in design.

Figure 7:
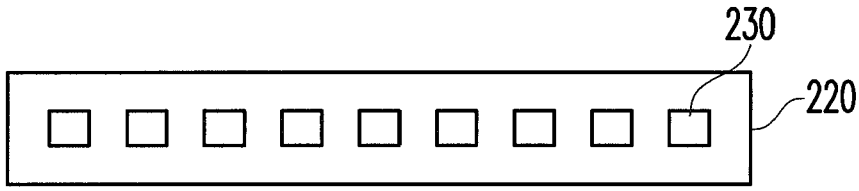
FIG. 7 is a drawing, schematically illustrating a LED pattern of the light source in an array, according to an embodiment of the present invention.
Figure 8:
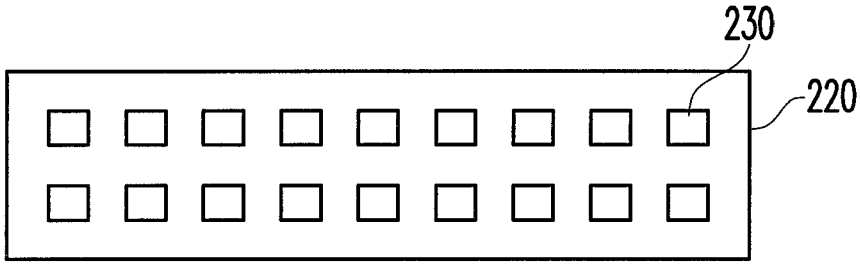
FIG. 8 is a drawing, schematically illustrating a LED pattern of the light source in a 2D array, according to an embodiment of the present invention.

FIG. 7 is a drawing, schematically illustrating a LED pattern of the light source in an array, according to an embodiment of the present invention. In FIG. 7, the LED pattern for the LEDs 230 may be in one dimensional array, disposed on the base to form a LED bar 220, which has the control circuit for supplying the variable voltage to each LED 230. Several LED strips 220 are also be implemented along the peripheral surface of the light integrating plate to surround it thereon. FIG. 8 is a drawing, schematically illustrating a LED pattern of the light source in a 2D array, according to an embodiment of the present invention. In FIG. 8, the LEDs 230 may also be arranged into 2D array, depending on the need in actual design.

Figure 9:
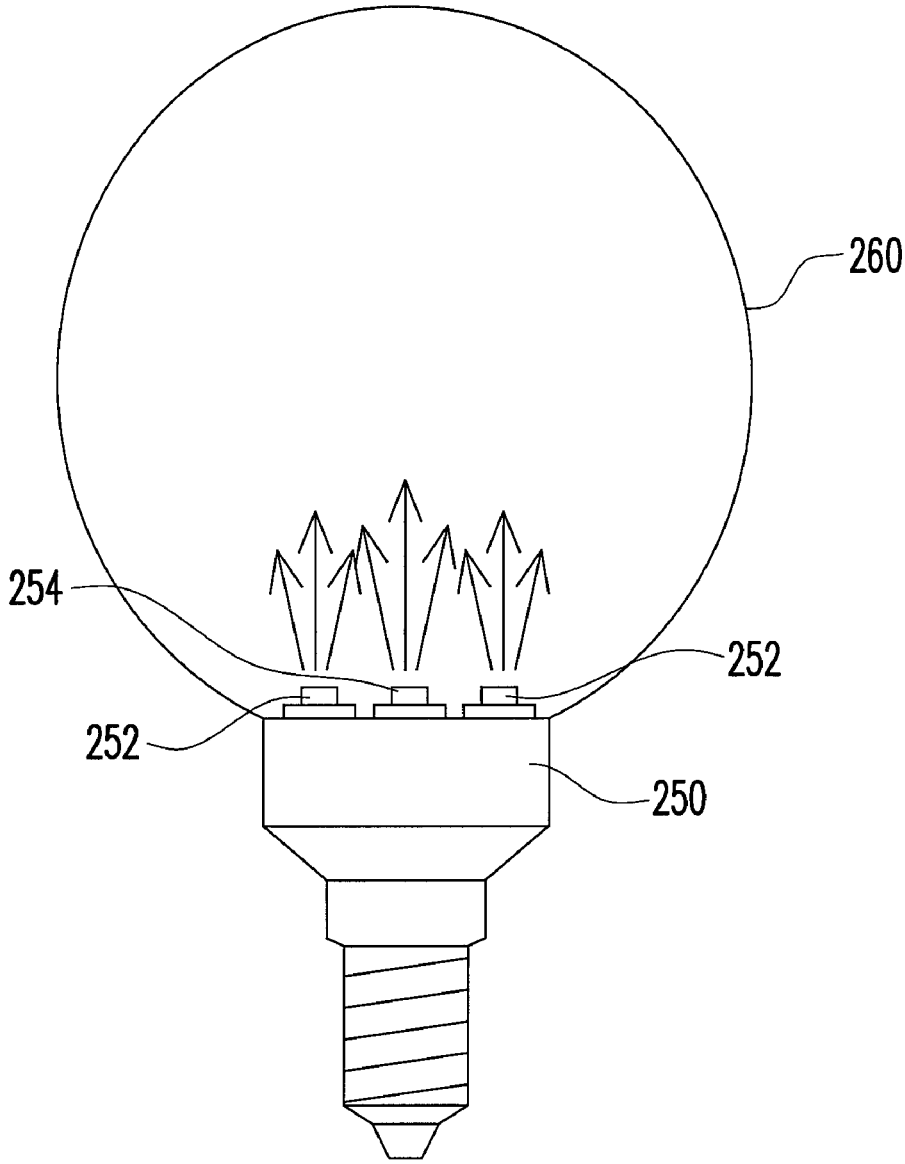
FIG. 9 is a drawing, schematically illustrating a structure of a light bulb lamp in perspective view, according to an embodiment of the present invention.

Alternatively, the light integrating device may be a light integrating envelope. FIG. 9 is a drawing, schematically illustrating a structure of a light bulb lamp in perspective view, according to an embodiment of the present invention. In FIG. 9, multiple LEDs may be implemented on a bulb base 250, which supplies the variable voltage to the LEDs. The LEDs include, for example, white LEDs 252 and color LEDs 254, such as amber LEDs or red LEDs. The light integrating envelope 260 covers over the LEDs 252 and 254 on the bulb base 250. Based on the control mechanism as described in the embodiment of the invention, the light may be dimmed while the color temperature is also properly descending.

Figure 10:
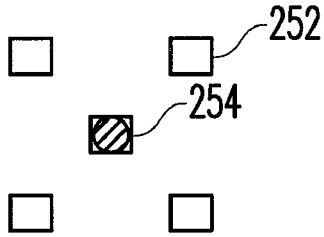
FIG. 10 is a drawing, schematically illustrating a LED pattern of the light source used in FIG. 9, according to an embodiment of the present invention.

FIG. 10 is a drawing, schematically illustrating a LED pattern of the light source used in FIG. 9, according to an embodiment of the present invention. In FIG. 10, the LED pattern may be any proper choice without a specific pattern. For example, the amber LED 254 may be disposed between the white LED 252. The number for the amber LED 254 may also be an option. In other words, based on the same adjusting mechanism for color temperature and the lumen output, the LED pattern may be properly taken for the actual design.

Figure 11:
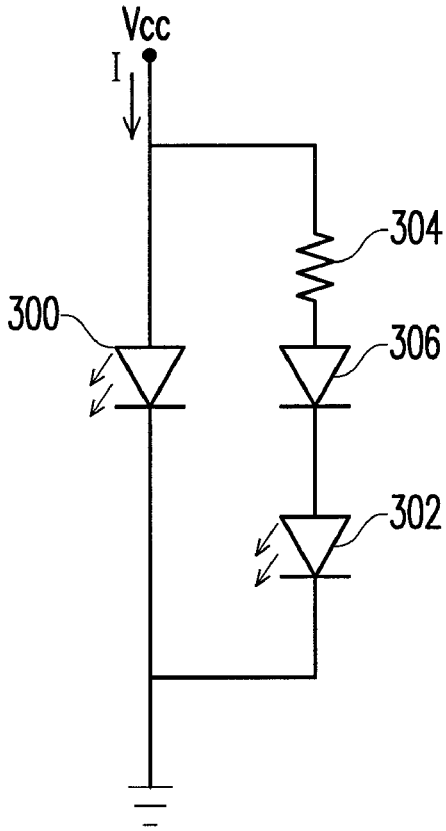
FIG. 11 is a drawing, schematically illustrating a driving circuit for the light source, according to an embodiment of the present invention.

It is also noted that when the white LED and the RED LED are used together, the standard operation voltage for the two types of LED may be different. However, the addition circuit may be used to drop the voltage. FIG. 11 is a drawing, schematically illustrating a driving circuit for the light source, according to an embodiment of the present invention. In FIG. 11, for example, the variable operation voltage Vcc is applied to the white LED 300, which needs higher operation voltage, such as 3.5V. The red LED may need a smaller operation voltage, such as 2.3V. In this situation, the additional resistor 304 may be added to drop the operation voltage. The additional diode 306 may be even more added. However, the single variable operation voltage Vcc is supplied on both types of LED. The control is easy and the color temperature may vary with the operation voltage when dimming the light.

From the method point of view, an embodiment of the invention also provides a method for producing a light using light-emitting diode (LED). The method includes providing at least one first LED, the first LED having a first optical illuminant characteristic varying with a variable operation voltage from a first level to a second level, wherein the first level is larger than the second level. The method also includes providing at least one second LED, the second LED having a second optical illuminant characteristic varying with the variable operation voltage from a third level to a fourth level, wherein the third level is smaller than the fourth level. Then, the variable operation voltage is simultaneously applied to the first LED and the second LED to produce a light.

The foregoing description of the preferred embodiments of the invention has been presented for purposes of illustration and description. It is not intended to be exhaustive or to limit the invention to the precise form or to exemplary embodiments disclosed. Accordingly, the foregoing description should be regarded as illustrative rather than restrictive. Obviously, many modifications and variations will be apparent to practitioners skilled in this art. The embodiments are chosen and described in order to best explain the principles of the invention and its best mode practical application, thereby to enable persons skilled in the art to understand the invention for various embodiments and with various modifications as are suited to the particular use or implementation contemplated. It is intended that the scope of the invention be defined by the claims appended hereto and their equivalents in which all terms are meant in their broadest reasonable sense unless otherwise indicated. Therefore, the term "the invention", "the present invention" or the like does not necessarily limit the claim scope to a specific embodiment, and the reference to particularly preferred exemplary embodiments of the invention does not imply a limitation on the invention, and no such limitation is to be inferred. The invention is limited only by the spirit and scope of the appended claims. The abstract of the disclosure is provided to comply with the rules requiring an abstract, which will allow a searcher to quickly ascertain the subject matter of the technical disclosure of any patent issued from this disclosure. It is submitted with the understanding that it will not be used to interpret or limit the scope or meaning of the claims. Any advantages and benefits described may not apply to all embodiments of the invention. It should be appreciated that variations may be made in the embodiments described by persons skilled in the art without departing from the scope of the present invention as defined by the following claims. Moreover, no element and component in the present disclosure is intended to be dedicated to the public regardless of whether the element or component is explicitly recited in the following claims.

What is claimed is:

1. A light source of light-emitting diode (LED), comprising:

at least one first LED, having a first optical illuminant characteristic varying with a variable operation voltage from a first level to a second level, wherein the first level is larger than the second level; and at least one second LED, having a second optical illuminant characteristic varying with the variable operation voltage from a third level to a fourth level, wherein the third level is smaller than the fourth level, wherein the first LED and the second LED are simultaneously controlled by the same variable operation voltage to produce a light, and when the variable operation voltage changes, the first optical illuminant characteristic adds with the second optical illuminant characteristic to have a smoothly descending curve and a color temperature of the light accordingly decreases, wherein when dimming the light, a color of the light accordingly changes from white approaching to red.

2. The light source of LED in claim 1, wherein the warm state is at color temperature of 2400K and the cool state is at color temperature of 3200K.

3. The light source of LED in claim 1, wherein the first LED is a white LED and the second LED is a color LED warmer than the white LED when the variable operation voltage is at full percentage of a reference voltage.

4. The light source of LED in claim 3, wherein the white LED is at color temperature of 3200K and the color LED is at color temperature of 1000K.

5. The light source of LED in claim 3, wherein the color LED is amber or red.

6. The light source of LED in claim 1, wherein the first LED and the second LED are equal in quantity.

7. The light source of LED in claim 1, wherein the first LED and the second LED are not equal in quantity.

8. The light source of LED in claim 1, further comprising a light integrating plate to receive the light from the first LED and the second LED at a side incident surface.

9. The light source of LED in claim 1, further comprising a light integrating envelope, covering the first LED and the second LED to receive the light.

10. The light source of LED in claim 1, wherein the first optical illuminant characteristic is smoothly descending from the first level to the second level and the second optical illuminant characteristic is smoothly increasing from the third level to the fourth level.

11. The light source of LED in claim 1, wherein the first optical illuminant characteristic is smoothly descending from the first level to the second level and the second optical illuminant characteristic is smoothly increasing and then descending from the third level to the fourth level.

12. A method for producing a light using light-emitting diode (LED), comprising:

providing at east one first LED, the first LED having a first optical illuminant characteristic varying with a variable operation voltage from a first level to a second level, wherein the first level is larger than the second level;

providing at least one second LED, the second LED having a second optical illuminant characteristic varying with the variable operation voltage from a third level to a fourth level, wherein the third level is smaller than the fourth level; and simultaneously applying the variable operation voltage to the first LED and the second LED to produce the light, wherein when the variable operation voltage changes, the first optical illuminant characteristic adds with the second optical illuminant characteristic to have a smoothly descending curve and a color temperature of the light accordingly decreases, wherein when dimming the light, a color of the light accordingly changes from white approaching to wherein both the first LED and the second LED are provided with white color, and the first LED starts from a warm state in color temperature and the second LED starts from a cool state in color temperature when the variable operation voltage is at full percentage of a reference voltage.

13. The method of claim 12, further comprising a light integrating device to integrate and mix each of individual lights of the first LED and the second LED.

14. The method claim 12, wherein the warm state is set at color temperature of 2400K and the cool state is set at color temperature of 3200K.

15. The method of claim 12, wherein the first LED is provided for emitting a white light and the second LED is provided for emitting a color light warmer than the white light when the variable operation voltage is at full percentage of a reference voltage.

16. The method in claim 15, wherein the color light of the second LED is amber or red.

* * * * *